US007410221B2

(12) United States Patent
Hall et al.

(10) Patent No.: US 7,410,221 B2
(45) Date of Patent: Aug. 12, 2008

(54) RETAINER SLEEVE IN A DEGRADATION ASSEMBLY

(76) Inventors: David R. Hall, 2185 S. Larsen Pkwy., Provo, UT (US) 84606; Ronald Crockett, 2185 S. Larsen Pkwy., Provo, UT (US) 84606; Jeff Jepson, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 89 days.

(21) Appl. No.: 11/558,835

(22) Filed: Nov. 10, 2006

(65) Prior Publication Data

US 2008/0036275 A1 Feb. 14, 2008

Related U.S. Application Data

(63) Continuation-in-part of application No. 11/464,019, filed on Aug. 11, 2006, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, which is a continuation-in-part of application No. 11/463,962, filed on Aug. 11, 2006, which is a continuation-in-part of application No. 11/463,953, filed on Aug. 11, 2006.

(51) Int. Cl.
*E21C 35/197* (2006.01)

(52) U.S. Cl. ..... 299/107

(58) Field of Classification Search ..... 299/107
See application file for complete search history.

(56) References Cited

U.S. PATENT DOCUMENTS

| | | | | |
|---|---|---|---|---|
| 2,004,315 | A | 6/1935 | Fean | |
| 2,124,438 | A | 7/1938 | Struk | |
| 3,254,392 | A | 6/1966 | Novkov | |
| 3,512,838 | A * | 5/1970 | Kniff | 299/104 |
| 3,746,396 | A | 7/1973 | Radd | |
| 3,807,804 | A | 4/1974 | Kriff | |
| 3,932,952 | A | 1/1976 | Helton | |
| 3,945,681 | A | 3/1976 | White | |
| 4,005,914 | A | 2/1977 | Newman | |

(Continued)

FOREIGN PATENT DOCUMENTS

| | | |
|---|---|---|
| DE | 4039217 | 6/1992 |

(Continued)

*Primary Examiner*—John Kreck
(74) *Attorney, Agent, or Firm*—Tyson J. Wilde; Benjamin T. Miskin

(57) ABSTRACT

A degradation assembly has an attack tool with a body and a shank. The body has a wear resistant tip with a hardness of at least 60 HRc. The shank is disposed within a bore of a holder secured to a driving mechanism. A retainer sleeve is disposed around the shank of the attack tool, wherein an annular gap of 0.002 to 0.010 inches exists between at least a portion of the sleeve and the shank.

16 Claims, 16 Drawing Sheets

U.S. PATENT DOCUMENTS 4,006,936 A 2/1977 Crabiel
4,098,362 A 7/1978 Bonnice
4,109,737 A 8/1978 Bovenkerk
4,156,329 A 5/1979 Daniels
4,199,035 A 4/1980 Thompson
4,201,421 A 5/1980 Den Besten
4,277,106 A 7/1981 Sahley
4,439,250 A 3/1984 Acharya
4,465,221 A 8/1984 Acharya
4,484,644 A 11/1984 Cook
4,489,986 A 12/1984 Dziak
4,678,237 A 7/1987 Collin
4,682,987 A 7/1987 Brady
4,688,856 A 8/1987 Elfgen
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,798,026 A * 1/1989 Cerceau ..... 451/540
4,836,614 A * 6/1989 Ojanen ..... 299/107
4,880,154 A 11/1989 Tank
4,940,288 A 7/1990 Stiffler
4,944,559 A 7/1990 Sionnet
4,951,762 A 8/1990 Lundell
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,332,348 A 7/1994 Lemelson
5,417,475 A * 5/1995 Graham et al. ..... 299/105
5,447,208 A 9/1995 Lund
5,535,639 A 7/1996 Brady
5,542,993 A 8/1996 Rabinkin
5,653,300 A 8/1997 Lund
5,738,698 A 4/1998 Kapoor
5,806,934 A * 9/1998 Massa et al. ..... 299/111
5,823,632 A 10/1998 Burkett
5,837,071 A 11/1998 Anderson
5,845,547 A 12/1998 Sollami
5,875,862 A 3/1999 Jurewicz
5,934,542 A 8/1999 Nakamura
5,935,718 A 8/1999 Demo
5,944,129 A 8/1999 Jenson
5,967,250 A 10/1999 Lund
5,992,405 A 11/1999 Sollami
6,006,846 A 12/1999 Tibbitts et al.
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,824,225 B2 11/2004 Stiffler
6,861,137 B2 3/2005 Griffin
6,889,890 B2 5/2005 Yamazaki
6,966,611 B1 11/2005 Sollami
6,994,404 B1 2/2006 Sollami
7,204,560 B2 4/2007 Mercier
2002/0175555 A1 * 11/2002 Mercier ..... 299/107
2003/0140350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2006/0237236 A1 10/2006 Sreshta

FOREIGN PATENT DOCUMENTS

DE 19821147 11/1999
EP 0295151 6/1988
EP 0412287 7/1990
JP 3123193 1/2001

* cited by examiner

RETAINER SLEEVE IN A DEGRADATION ASSEMBLY

CROSS REFERENCE IS RELATED APPLICATIONS

This application is a continuation-in-part of U.S. patent application Ser. No. 11/464,019 filed on Aug. 11, 2006 and titled Sleeve in a Degradation Assembly. U.S. patent application Ser. No. 11/464,019 is a continuation-in-part of U.S. patent application Ser. No. 11/464,008 which was filed on Aug. 11, 2006 now U.S. Pat. No. 7,338,135 and entitled Holder for a Degradation Assembly. U.S. patent application Ser. No. 11/464,008 is a continuation-in-part of U.S. patent application Ser. No. 11/463,998 which was filed on Aug. 11, 2006 now U.S. Pat. No. 7,384,105 and entitled Washer for a Degradation Assembly. U.S. patent application Ser. No. 11/463,998 is a continuation-in-part of U.S. patent application Ser. No. 11/463,990 which was filed on Aug. 11, 2006 now U.S. Pat. No. 7,320,505 and entitled An Attack Tool. U.S. patent application Ser. No. 11/463,990 is a continuation-in-part of U.S. patent application Ser. No. 11/463,975 which was filed on Aug. 11, 2006 and entitled An Attack Tool. U.S. patent application Ser. No. 11/463,975 is a continuation-in-part of U.S. patent application Ser. No. 11/463,962 which was filed on Aug. 11, 2006 and entitled An Attack Tool. U.S. patent application Ser. No. 11/463,962 is a continuation-in-part of U.S. patent application Ser. No. 11/463,953, which was also filed on Aug. 11, 2006 and entitled An Attack Tool. All of these applications are herein incorporated by reference for all that it contains.

BACKGROUND OF THE INVENTION

Efficient degradation of materials is important to a variety of industries including the asphalt, mining, and excavation industries. In the asphalt industry, pavement may be degraded using attack tools, and in the mining industry, attack tools may be used to break minerals and rocks. Attack tools may also be used when excavating large amounts of hard materials. In asphalt recycling, often, a drum supporting an array of attack tools disposed within holders, together making up a degradation assembly, may be rotated and moved so that the attack tools engage a paved surface causing the tools and/or holders to wear. Much time is wasted in the asphalt recycling industry due to high wear of the degradation assemblies, which typically have a tungsten carbide tip.

U.S. Pat. No. 6,733,087 to Hall et al., which is herein incorporated by reference for all that it contains, discloses an attack tool for working natural and man-made materials that is made up of one or more segments, including a steel alloy base segment, an intermediate carbide wear protector segment, and a penetrator segment comprising a carbide substrate that is coated with a superhard material. The segments are joined at continuously curved interfacial surfaces that may be interrupted by grooves, ridges, protrusions, and posts. At least a portion of the curved surfaces vary from one another at about their apex in order to accommodate ease of manufacturing and to concentrate the bonding material in the region of greatest variance.

Examples of degradation assemblies from the prior art are disclosed in U.S. Pat. No. 6,824,225 to Stiffler, US Pub. No. 20050173966 to Mouthaan, U.S. Pat. No. 6,692,083 to Latham, U.S. Pat. No. 6,786,557 to Montgomery, Jr., US. Pub. No. 20030230926, U.S. Pat. No. 4,932,723 to Mills, US Pub. No. 20020175555 to Merceir, U.S. Pat. No. 6,854,810 to Montgomery, Jr., U.S. Pat. No. 6,851,758 to Beach, which are all herein incorporated by reference for all they contain.

BRIEF SUMMARY OF THE INVENTION

A degradation assembly has an attack tool with a body and a shank. The body has a wear resistant tip with a hardness of at least 60 HRc. The shank is disposed within a bore of a holder secured to a driving mechanism. A retainer sleeve is disposed around the shank of the attack tool, wherein an annular gap of 0.002 to 0.015 inches exists between at least a portion of the sleeve and the shank.

The retainer sleeve may comprise at least one protrusion extending from an inner surface of the sleeve. The protrusion may be a bump, a ring, a rib, or combinations thereof.

The retainer sleeve may comprise an inner surface comprising a hardness greater than 58 HRc. The inner surface may comprise a material selected from the group consisting of hardened steel, chromium, tungsten, tantalum, niobium, titanium, molybdenum, carbide, natural diamond, polycrystalline diamond, vapor deposited diamond, cubic boron nitride, aluminum oxide, zircon, silicon, whisker reinforced ceramics, diamond impregnated carbide, diamond impregnated matrix, silicon bonded diamond, and combinations thereof. The material may comprise a thickness between 0.0001 and 0.5 inches.

The inner surface of the sleeve may be polished. The inner surface may comprise layers. The inner surface may be made of polycrystalline ceramic with a binder concentration of 4 to 35 weight percent.

The retainer sleeve may be a spring. The retainer sleeve may comprise a dividing slit. The retainer sleeve may comprise a lip proximate an outer edge. The retainer sleeve may comprise a guide slot. The shank may comprise a guide pin, the guide slot of the retainer sleeve being adapted to receive the guide pin. The retainer sleeve may comprise a thickness from 0.01 to 0.5 inches. A first end of the retainer sleeve may comprise a larger diameter than a second end of the retainer sleeve.

The wear resistant tip may comprise a material selected from the group consisting of chromium, tungsten, tantalum, niobium, titanium, molybdenum, carbide, natural diamond, polycrystalline diamond, vapor deposited diamond, cubic boron nitride, aluminum oxide, zircon, silicon, whisker reinforced ceramics, diamond impregnated carbide, diamond impregnated matrix, silicon bonded diamond, and combinations thereof. The wear resistant tip may comprise a binder concentration of 4 to 35 weight percent. The wear resistant tip may comprise an average grain size of 0.5 to 200 microns.

A method for manufacturing a degradation assembly comprises providing an attack tool comprising a body and a shank, a holder comprising a bore, and a retainer sleeve; adding a hard material to an inner surface of the retainer sleeve; fitting the retainer sleeve around the shank of the attack tool, wherein an annular gap of 0.002 to 0.015 inches exists between at least a portion of the sleeve and the shank; and inserting the shank and the retainer sleeve into the bore of the holder such that the retainer sleeve retains the shank within the bore.

DETAILED DESCRIPTION OF THE INVENTION AND THE PREFERRED EMBODIMENT

Figure 1:
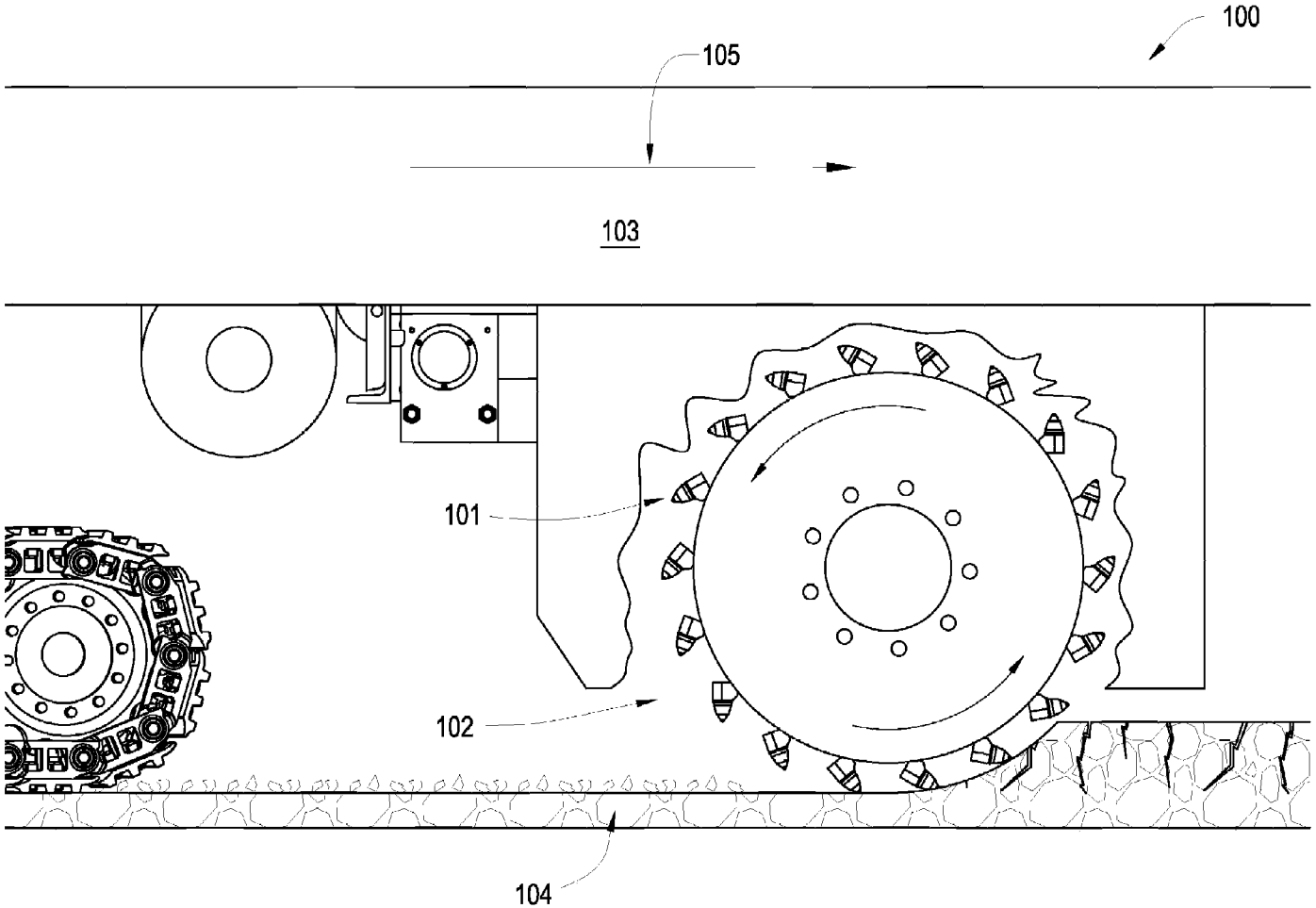
FIG. 1 is a cross sectional diagram of an embodiment of an asphalt milling machine.

According to one aspect of the invention and referring to FIG. 1, an asphalt milling machine 100 may comprise a driving mechanism 102 attached to a motor vehicle 103. A plurality of degradation assemblies 101 may be secured to the driving mechanism 102. The driving mechanism 102 may be a rotating drum, a chain, a rotor, or combinations thereof. The asphalt milling machine 100 may degrade a paved surface 104 of a road, sidewalk, or parking lot prior to applying new pavement. The driving mechanism 102 may rotate such that the degradation assemblies 101 engage the paved surface 104 as the motor vehicle 103 moves in a direction indicated by the arrow 105. In other embodiments of the invention, the driving mechanism 102 may be attached to a mining vehicle or other drilling machine.

Figure 2:
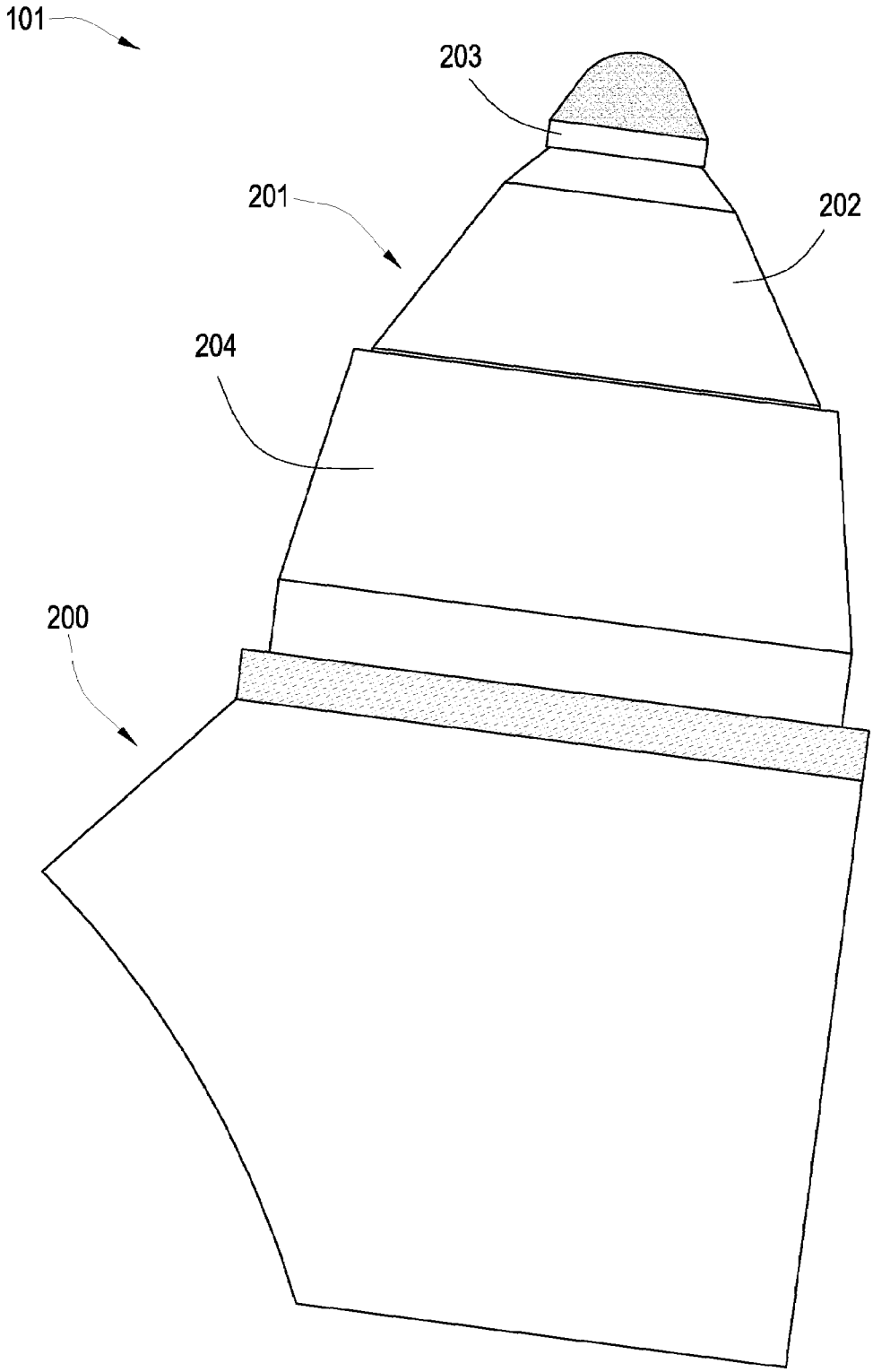
FIG. 2 is a perspective diagram of an embodiment of a degradation assembly.
Figure 3:
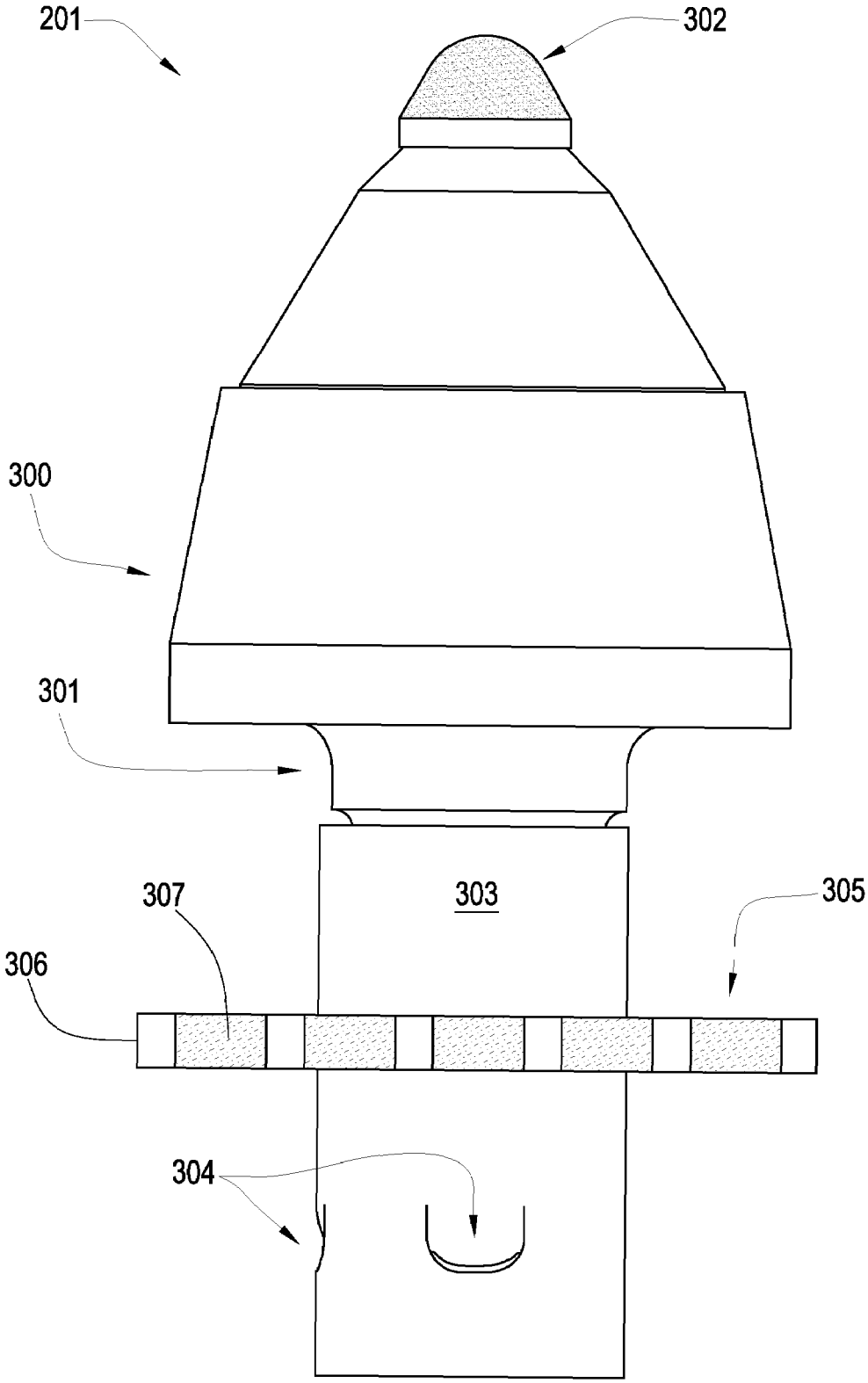
FIG. 3 is a perspective diagram of an embodiment of an attack tool.

Referring to FIGS. 2 and 3, the degradation assembly 101 comprises a holder 200 and an attack tool 201. The attack tool 201 comprises a body 300 and a shank 301, wherein the shank 301 is disposed within a bore of the holder 200. The body 300 comprises a first and a second carbide segment 202, 203 and a steel portion 204. The steel portion 204 may comprise a hardness of 35 to 55 HRc. The first carbide segment 202 may be brazed to the steel portion 204. The second carbide segment 203 may be brazed to the first carbide segment 202 and also comprise a wear-resistant tip 302 with a material having a hardness greater than 4,000 HK according to the Knoop Hardness scale. In some embodiments, the wear-resistant tip 302 may be bonded directly to the first segment 202. It may be desirable to have the first and second carbide segments 202, 203 in embodiments where the wear-resistant tip 302 comprises a ceramic formed in a high temperature high pressure press, so that the second carbide segment 203 may be bonded to the ceramic in the press. The wear-resistant tip 302 may comprise a superhard material made of polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof. The superhard material may be 1 to 20000 microns thick. In embodiments, where the superhard material is a ceramic, the material may comprise a region (preferably near its surface) that is free of binder material. The average grain size of a superhard ceramic may be 0.02 to 100 microns in size. Infiltrated diamond is typical made by sintering the superhard material adjacent a cemented metal carbide and allowing a metal (such as cobalt) to infiltrate into the superhard material. The superhard material may be a synthetic diamond comprising a binder concentration of 1 to 35 weight percent.

Because the wear resistant tip may extend the lifespan of the attack tool by at least 10 times the lifespan of an attack tool without a wear resistant tip, other areas of the degradation assembly—such as the washer, sleeve, shank, and holder—start to experience wear which had not been an issue before. Therefore, it is advantageous to optimize the lifespan of these areas in order to maximize the lifespan of the entire degradation assembly.

The degradation assembly 101 may comprise a retainer sleeve 303 disposed around the shank 301 of the attack tool 201. The sleeve 303 may be indented such that protrusions of the indented areas 304 complement a radially recessed portion of the shank, allowing the sleeve 303 to grip the shank 301 when under compression, while still allowing the shank to rotate. The sleeve 303 may also be a spring so that when the shank 301 and sleeve 303 are inserted into the bore of the holder 200, the sleeve 303 expands to fit tightly into the bore while maintaining a grip on the shank 301. The shank may also be made of steel, or it may comprise a wear-resistant material comprising a hardness greater than 58 HRc.

The degradation assembly may also comprise a washer 305 positioned in-between the body 300 of the attack tool 201 and the holder 200 and fitted around the shank 301 of the attack tool 201. The washer 305 may provide protection for the holder 200 against degraded materials or against any rotation of the body 301 of the attack tool 201. The washer 305 may be made of a ceramic comprising a binder concentration of 4 to 35 weight percent. It is believed that a higher binder weight concentration may allow the washer 305 to absorb more pressure or shock received by the body 300 of the attack tool 201. A preferred binder is cobalt. The washer may consist of a hardness greater than 58 HRc.

The washer 305 may also comprise an outer edge 306 with a material 307 of hardness greater than 58 HRc, according to the Rockwell Hardness C scale. The material 307 may comprise chromium, tungsten, tantalum, niobium, titanium, molybdenum, carbide, natural diamond, polycrystalline diamond, vapor deposited diamond, cubic boron nitride, diamond impregnated carbide, diamond impregnated matrix, silicon bonded diamond, or combinations thereof. The material 307 may be continuous on the outer edge, as in the embodiment of FIG. 2, or it may be segmented, as in the embodiment of FIG. 3. The material 307 may be added to the washer by electroplating, electroless plating, cladding, hot dipping, galvanizing, physical vapor deposition, chemical vapor deposition, thermal diffusion, or thermal spraying. The material 307 may also comprise an average grain size between 0.5 μm and 200 μm. The material 307 on the outer edge 306 of the washer 305 may comprise a thickness between 0.001 inch to 1 inch.

Figure 4:
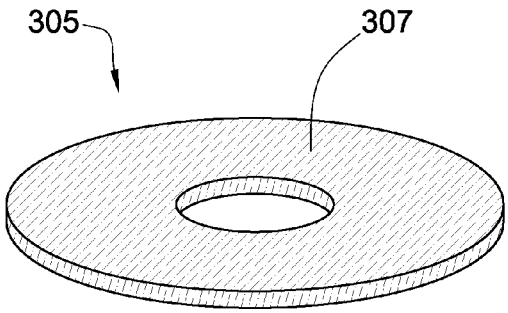
FIG. 4 is a perspective diagram of an embodiment of a washer.
Figure 5:
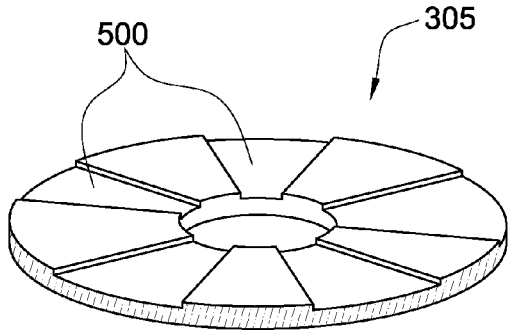
FIG. 5 is a perspective diagram of another embodiment of a washer.
Figure 6:
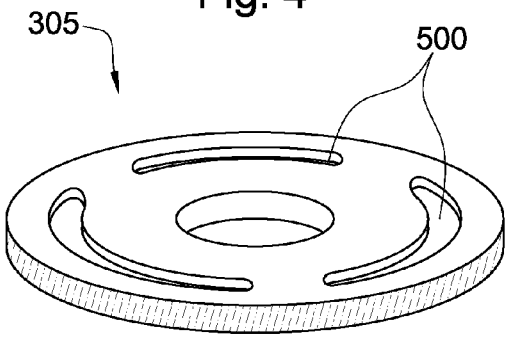
FIG. 6 is a perspective diagram of another embodiment of a washer.
Figure 7:
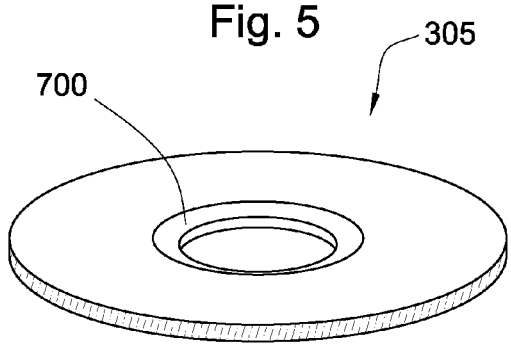
FIG. 7 is a perspective diagram of another embodiment of a washer.
Figure 8:
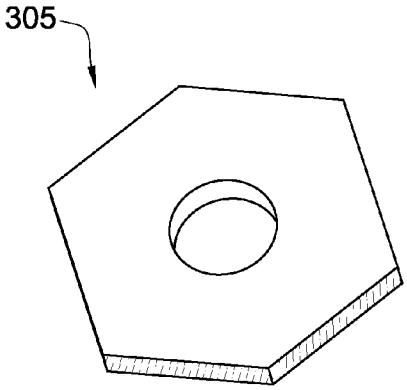
FIG. 8 is a perspective diagram of another embodiment of a washer.
Figure 9:
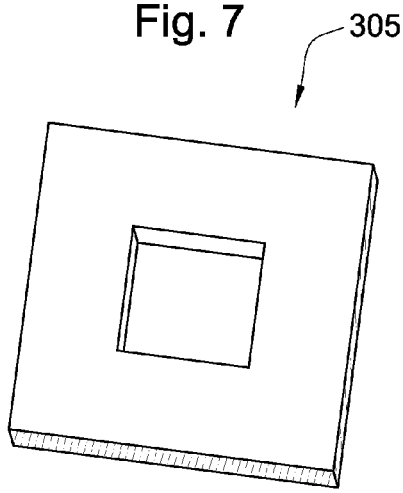
FIG. 9 is a perspective diagram of another embodiment of a washer.

FIGS. 4 through 9 are perspective diagrams of separate embodiments of washers 305 that may be used with the present invention. Referring to FIG. 4, an entire surface of the washer 305 may be covered with a material 307 of hardness greater than 58 HRc, or the washer 305 may be entirely made of the material 307. Referring to FIGS. 5 and 6, a surface of the washer 305 may comprise a plurality of recesses 500 or patterns. Referring now to FIG. 7, the washer 305 may comprise a beveled surface 700. The washer 305 may also comprise a plurality of layers, wherein an intermediate layer 1151 may be used to improve the strength or the bond of the material 307 bonded to the outer edge 306 of the washer 305. This may be advantageous in embodiments where a material 307 such as diamond is bonded to a steel surface. Since diamond does not bond well directly to steel, a layer 1151 of different material such as tungsten carbide may be bonded to the steel, and the diamond may then be bonded to the tungsten carbide. The washer 305 may comprise any shape, as in FIGS. 8 and 9, and may be adapted to fit around shanks 301 of different sizes or shapes.

Figure 10:
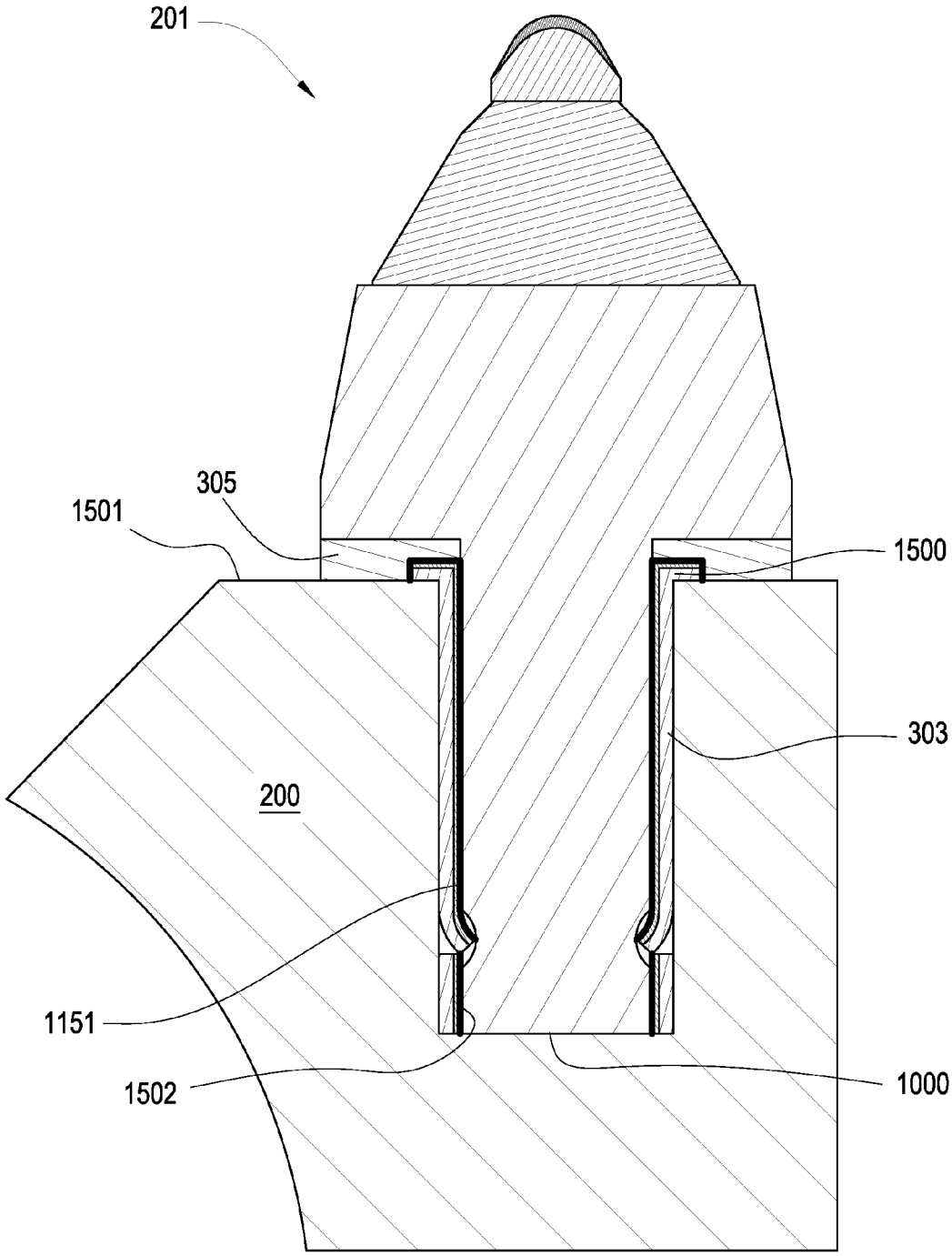
FIG. 10 is a cross-sectional diagram of another embodiment of a degradation assembly.
Figure 11:
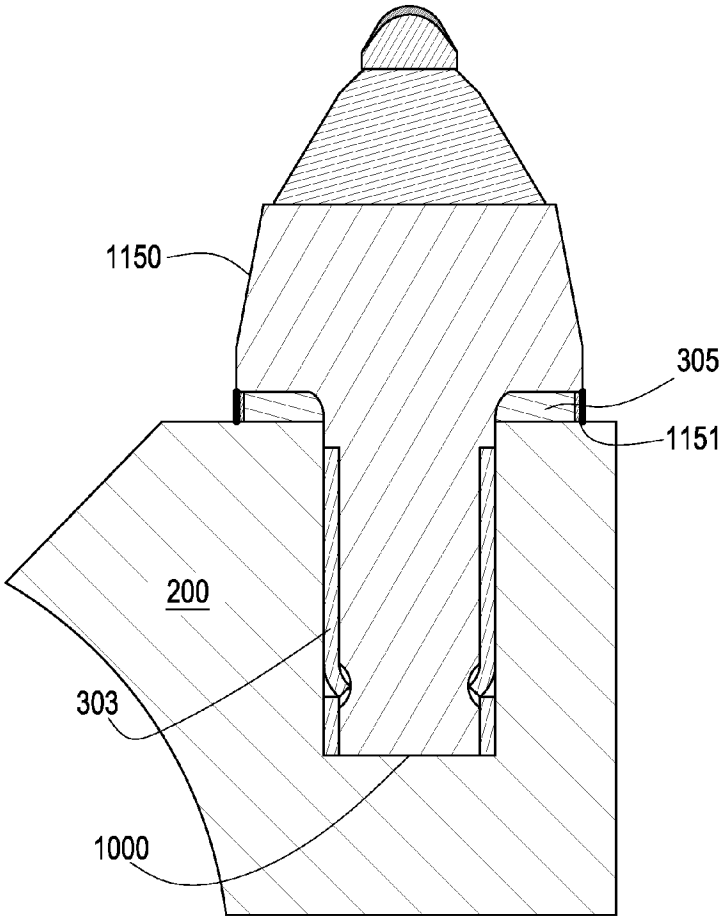
FIG. 11 is a cross-sectional diagram of another embodiment of a degradation assembly.

Referring to FIGS. 10 and 11, the washer 305 may comprise any thickness such that the body length-to-washer thickness ratio is between and including 1:1 to 15:1. A thick washer 305 may allow for more impact absorption. The washer 305 may also be polished to allow for easier, less abrasive rotation in embodiments wherein the attack tool 201 is allowed to rotate within the bore 1000 of the holder 200. The outer edge 306 of the washer 305 may be flush with an outer edge 1150 of the body 300 of the attack tool 201. The outer edge 306 of the washer 305 may also comprise a larger diameter than the outer edge 1150 of the body of the attack tool, or it may comprise a smaller diameter. A retainer sleeve 303 may be disposed entirely within the bore 1000 of the holder 200, as in the embodiment of FIG. 10, or it may extend beyond an opening of the bore, as in the embodiment of FIG. 11.

Figure 12:
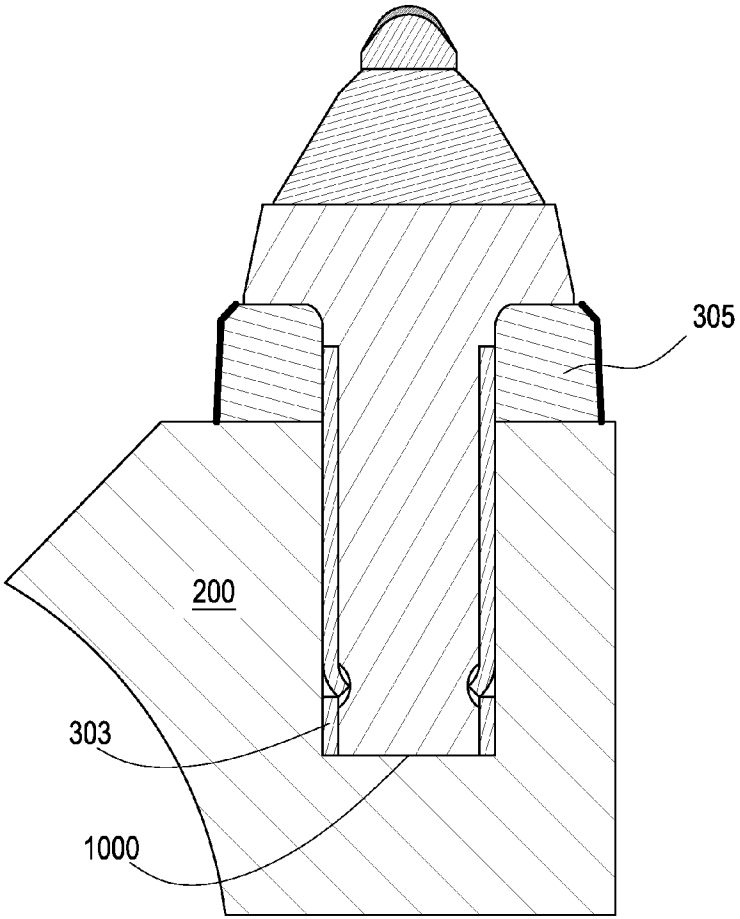
FIG. 12 is a perspective diagram of an embodiment of a retainer sleeve.

Referring to FIG. 12, the retainer sleeve 303 may comprise an inner surface 1502 with a hardness greater than 58 HRc. In some embodiments, any surface of the sleeve 303 may comprise a hardness greater than 58 HRc. The hardness may be achieved by bonding a material 307 comprising chromium, hard chrome, thin dense chrome, flash chrome, tungsten, tantalum, niobium, titanium, molybdenum, carbide, natural diamond, polycrystalline diamond, vapor deposited diamond, cubic boron nitride, aluminum oxide, zircon, silicon, whisker reinforced ceramics, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bonded diamond, or combinations thereof to any of the surfaces of the sleeve.

The sleeve 303 may comprise a lip 1500 proximate an outer edge of the sleeve. The lip 1500 may extend beyond the opening of the bore 1000 of the holder 200. The washer 305 may be recessed such that the washer 305 fits over the lip 1500, and so that the lip 1500 and the washer 305 are both flush against a top surface 1501 of the holder 200. An intermediate layer 1151 may be used to improve the strength or the bond of the material 307 bonded to the surface 1502 of the sleeve 303.

The material 307 may line the sleeve 305 at any part which may come in contact with the washer 305, such as along upper or outer edges of the lip 1500. The material 307 may be added to the sleeve by electroplating, electroless plating, cladding, hot dipping, galvanizing, thermal spraying chemical vapor deposition, thermal diffusion, or physical vapor deposition. Material 307 may also be added to an outer surface of the shank 301 by the same methods. In some embodiments, the shank 301 and the sleeve 303 may comprise the same composition of material 307, or they may comprise different compositions of material 307. Both surfaces may be polished.

Figure 13:
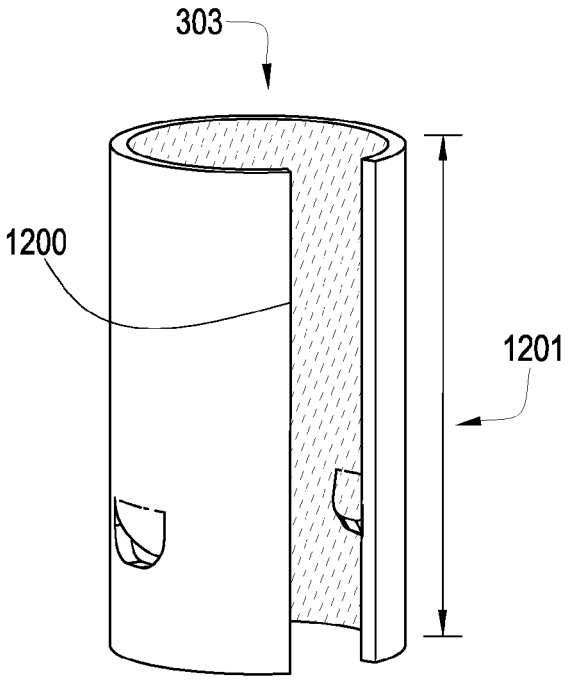
FIG. 13 is a perspective diagram of another embodiment of a retainer sleeve.
Figure 14:
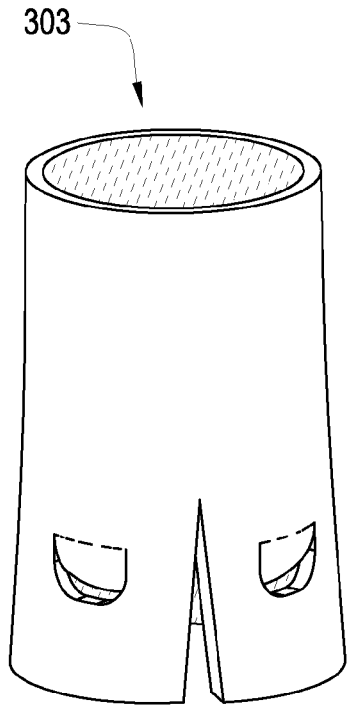
FIG. 14 is a perspective diagram of another embodiment of a retainer sleeve.
Figure 15:
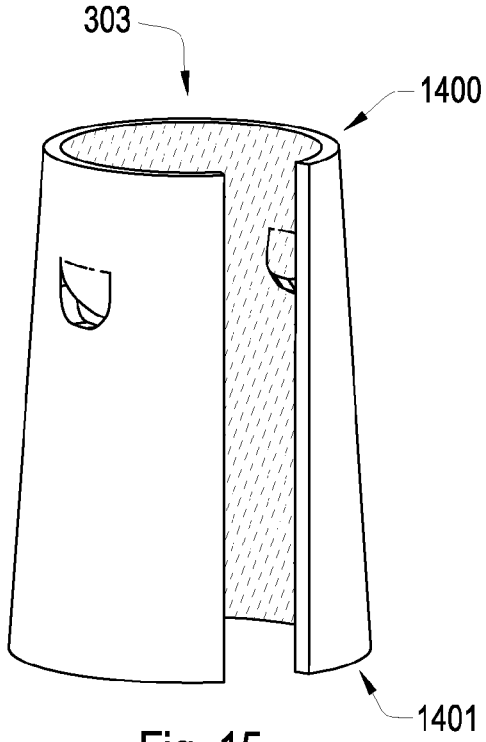
FIG. 15 is a cross-sectional diagram of another embodiment of a degradation assembly.

FIGS. 13 through 15 are perspective diagrams of separate embodiments of retainer sleeves 303. The retainer sleeve 303 may comprise a dividing slit 1200 which spans an axial length 1201, as in FIG. 13. This embodiment may be advantageous in allowing the sleeve 303 to expand within the bore 1000, establishing a compressive connection between the bore 1000 and the sleeve 303. The slit 1200 may also span only a portion of the axial length 1200 of the sleeve 303, as in FIG. 14. This embodiment may allow the sleeve 303 to maintain a strong grip on the shank 301 of the attack tool 201 and the holder 200. The embodiment of FIG. 15 comprises a different diameter at a first end 1400 than at a second end 1401 of the sleeve 303. This embodiment may provide a stronger compressive connection between the bore 1000 and the sleeve 303. The retainer sleeve may comprise a thickness between and including 0.01 inches to 0.5 inches.

Figure 16:
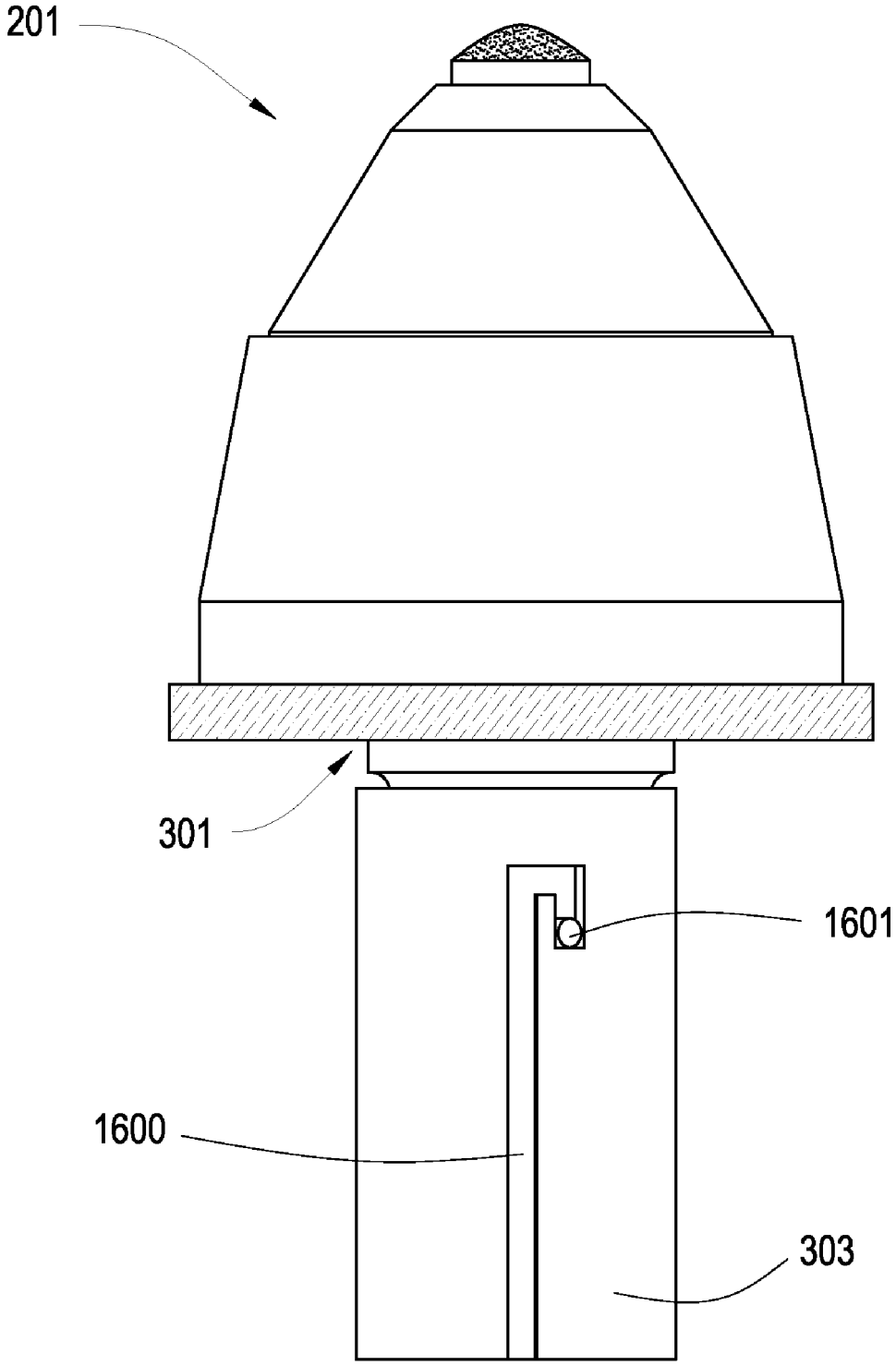
FIG. 16 is a perspective diagram of another embodiment of an attack tool.

In the embodiment of FIG. 16, the retainer sleeve 303 comprises a guide slot 1600, wherein a guide pin 1601 attached to the shank 301 of the attack tool 201 may fit within the guide slot 1600. The guide pin 1601 may be spring-loaded and the bore 1000 may comprise a receiving slot such that when the shank 301 and the sleeve 303 are inserted into the bore 1000 of the holder 200, the pin 1601 is not allowed to move vertically within the guide slot 1600, keeping the attack tool 201 stationary with respect to the sleeve 303. The attack tool 201 may also be stationary with respect to the holder 200.

Figure 17:
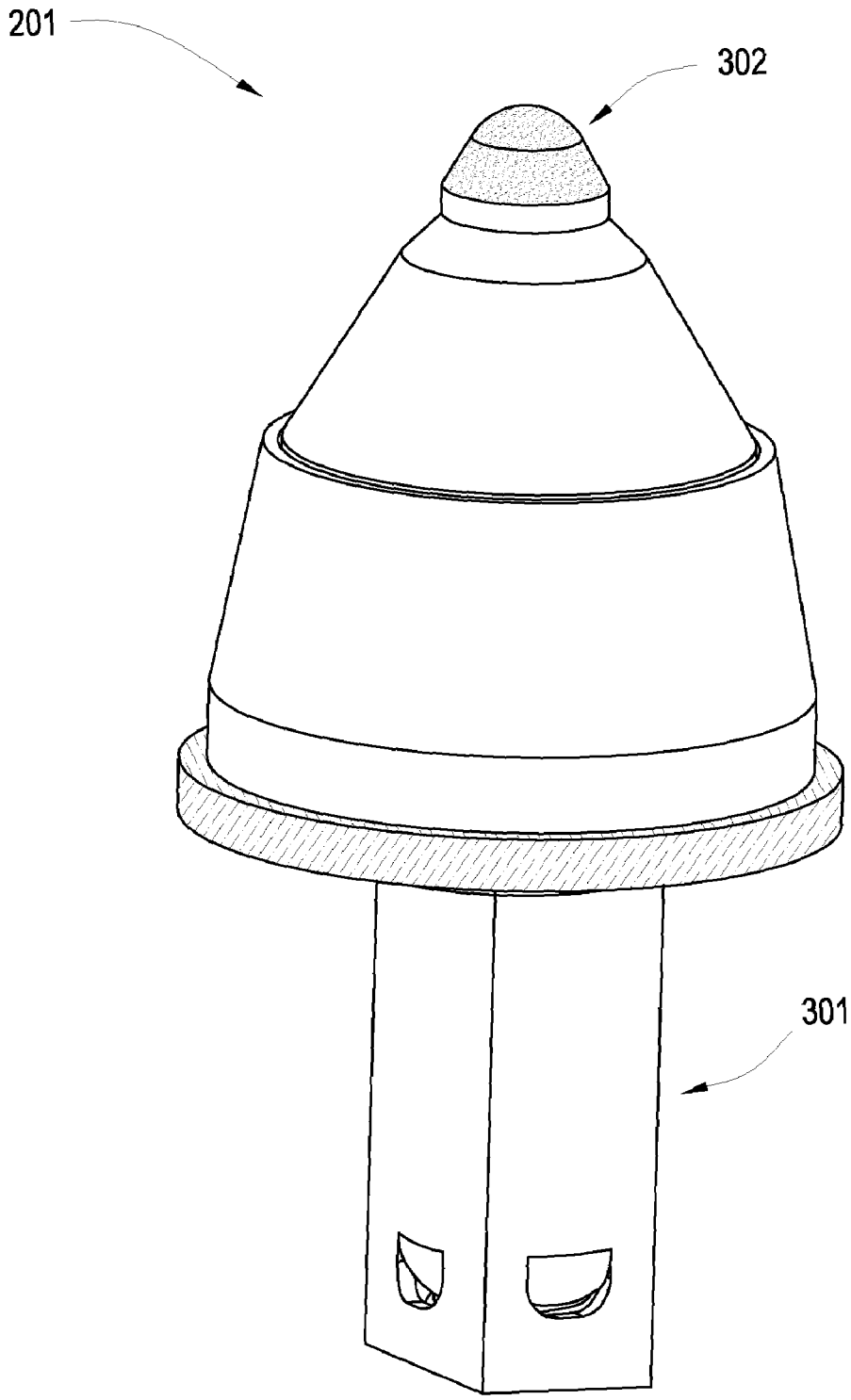
FIG. 17 is a perspective diagram of another embodiment of an attack tool.

Referring to FIG. 17, the shank 301 may also comprise any shape, size, or length and be adapted to fit into a bore 1000 of any shape, size, or length. This may be advantageous when using attack tools 201 that are designed to be rotationally stationary during operation of the driving mechanism 102. Degrading a hard formation may not cause significant wear to the wear-resistant tip 302, allowing the attack tool 201 to be stationary with respect to the holder 200 without altering the effectiveness of the attack tool 201.

Figure 18:
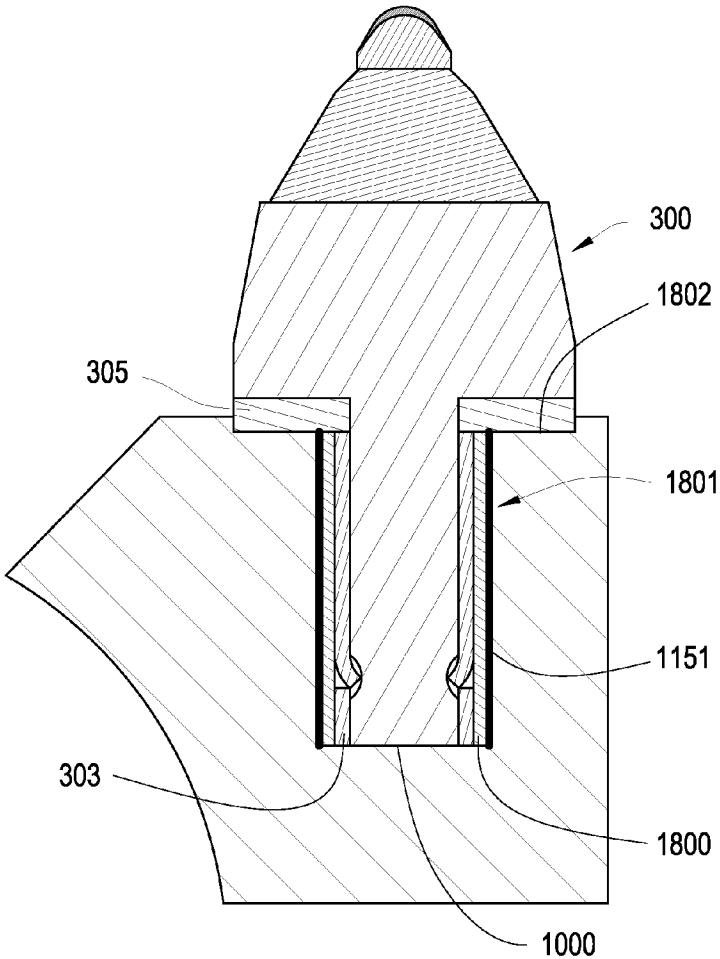
FIG. 18 is a cross-sectional diagram of another embodiment of a degradation assembly.

In the embodiment of FIG. 18, the bore 1000 of the holder 200 may comprise an inner surface 1800 comprising a material 307 with a hardness greater than 58 HRc. The material 307 of the inner surface 1800 of the bore 1000 may be selected from the group consisting of chromium, tungsten, tantalum, niobium, titanium, molybdenum, carbide, natural diamond, polycrystalline diamond, vapor deposited diamond, cubic boron nitride, aluminum oxide, zircon, silicon, whisker reinforced ceramics, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bonded diamond, nitride and combinations thereof. The material 307 of the inner surface 1800 may comprise a thickness between 0.0001 inches and 0.5 inches.

The inner surface 1800 of the bore may be polished, causing less friction and subsequent wear on the retainer sleeve 303 while also creating a stronger hold with the retainer sleeve 303. The inner surface 1800 of the bore 1000 may also comprise a polycrystalline ceramic with a binder concentration of 4 to 35 weight percent. The binder may comprise elements such as cobalt which strengthens the hard material and allow for better absorption of impact forces. The inner surface 1800 of the bore 1000 may also comprise a plurality of layers bonded together. The layers may comprise different compositions of elements, which may provide protection from various forces such as abrasion, impact, or shearing. An intermediate layer 1151 may be used to improve the strength or the bond of the wear-resistant material 307 bonded to the inner surface of the bore of the holder.

The material 307 of the inner surface 1800 may also be a removable component such as an additional sleeve 1801. The sleeve may be compressively bonded to the inner surface 1800 of the bore 1000 and may also be adapted to fit around the retainer sleeve 303 such that both the sleeve 1801 of the inner surface 1800 and the retainer sleeve 303 fit inside the bore 1000 of the holder 200 and around the shank 301 of the attack tool 201.

The holder 200 may also comprise a recessed portion 1802 wherein an opening of the bore 1000 is disposed within the recessed portion 1802. All or part of the washer 305 or part of the body 300 of the attack tool 201 may be disposed within the recessed portion 1802. The recessed portion 1802 may be adapted to receive any shape of washer 305. The washer 305 may be rotationally fixed to the holder 200 in some embodiments by a slot, a tab, or other means.

Figure 19:
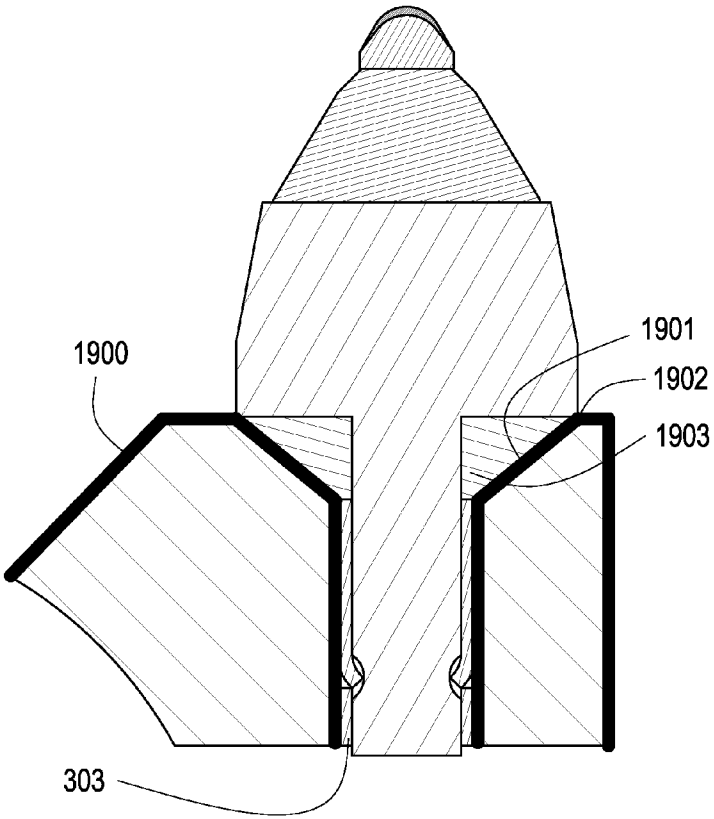
FIG. 19 is a cross-sectional diagram of another embodiment of a degradation assembly.

In the embodiment of FIG. 19, the holder 200 comprises a material 307 on an outer surface 1900 in addition to the material 307 of the inner surface 1800 of the bore 1000. This may provide protection against degraded elements that impact the outer surface 1900 while the driving mechanism 102 is in operation. The material may prevent significant wear on the outer surface 1900 of the holder 200, allowing for a better life-span of the holder 200. The holder 200 may also comprise a beveled opening 1901. The beveled opening 1901 may receive a washer 305 comprising different inner and outer thicknesses 1901, 1902. The bore 1000 may also comprise a square opening adapted to receive a square shank 301.

Figure 21:
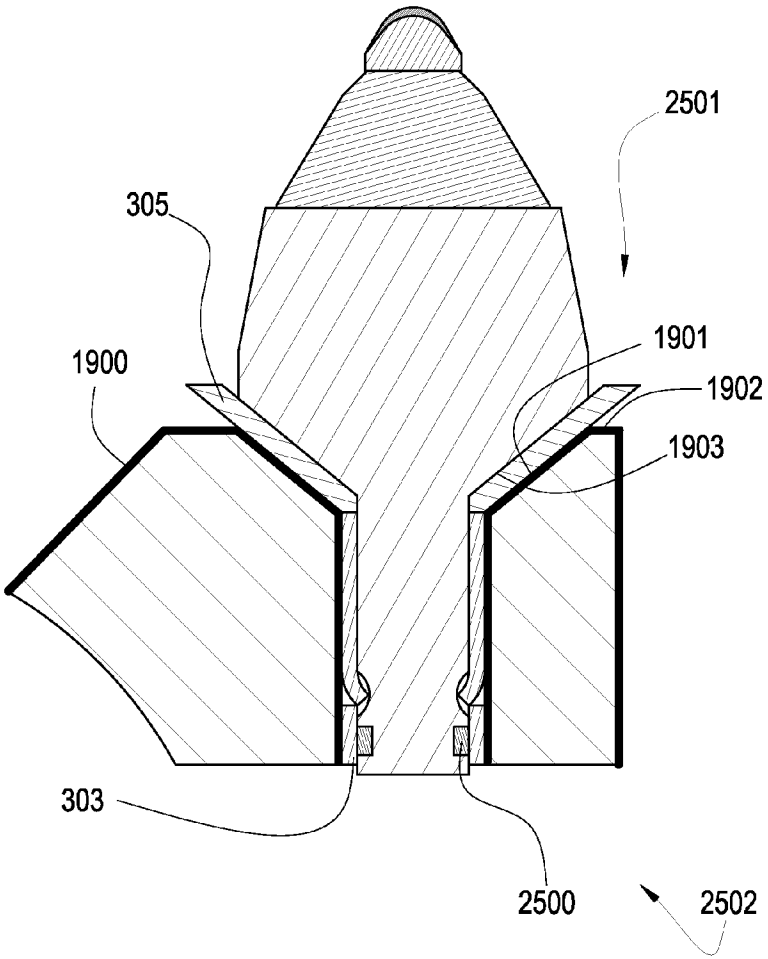
FIG. 21 is a cross-sectional diagram of another embodiment of a degradation assembly.
Figure 20:
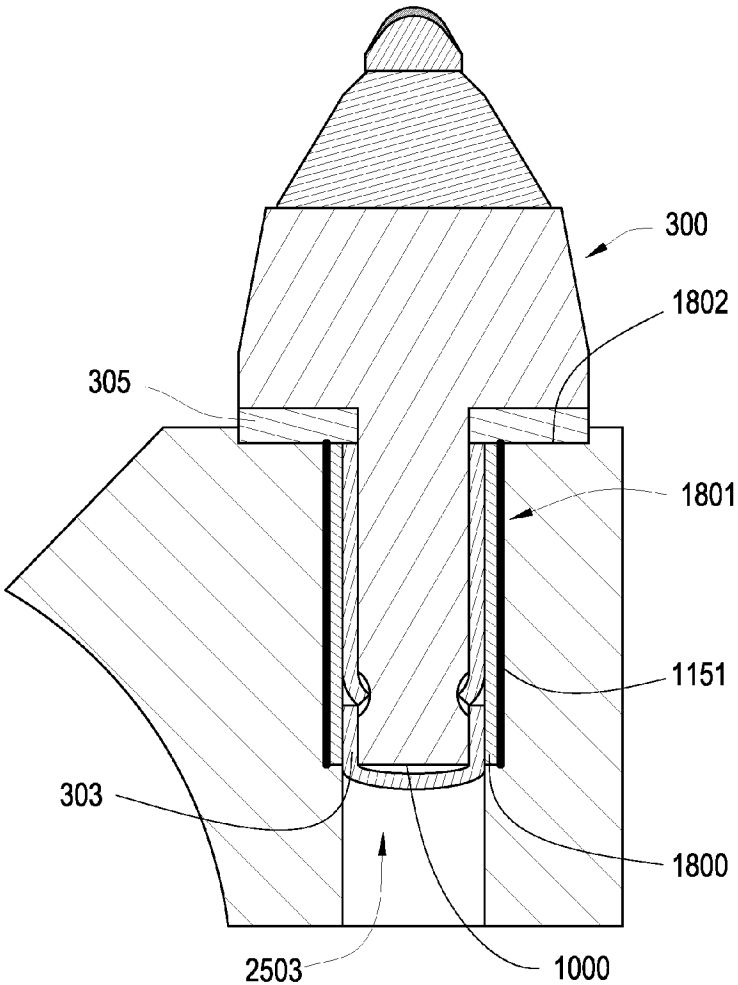
FIG. 20 is a cross-sectional diagram of another embodiment of a degradation assembly.

Now referring to FIGS. 20 and 21, there may be a seal 2500 disposed between the inner surface of the bore and the sleeve or the seal may be disposed between the sleeve and the shank. Either seal may be placed adjacent a forward end 2501 or a rearward end 2502 of the sleeve. The seal 2500 may provide the benefit of preventing debris from getting between the sleeve and the holder or between the sleeve and the shank. In some embodiments, the washer 305 may be angled such that it seals the debris from entering between the sleeve and the holder and/or the sleeve and shank. In other embodiments, the rearward end of the sleeve may comprise a closed end 2503. The seals 2500 may comprises a plastic plug, oily cloth, felt, metal seals, gasket, or combinations thereof.

Figure 22:
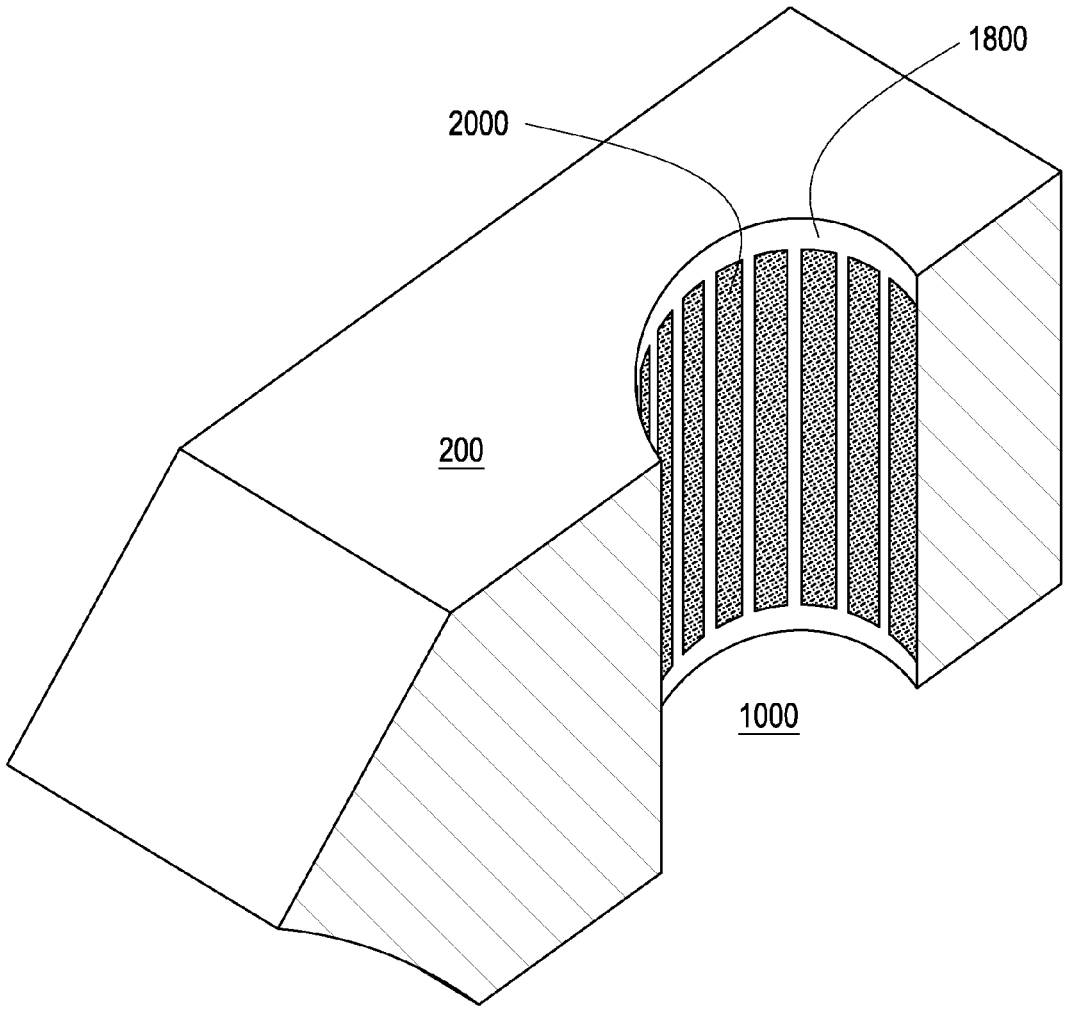
FIG. 22 is a cross-sectional diagram of an embodiment of a holder.

Referring to FIG. 22, the material 307 of the inner surface 1800 of the bore 1000 may be segmented. Segmented material 2000 may be positioned such that they may direct any rotation of the attack tool 201. Segmented material 2000 may be more cost effective than a continuous layer of material 307, while providing adequate protection from damaging forces. The material 307 may be added to the inner or outer surfaces 1800, 1900 of the holder 200 by electroplating, electroless plating, cladding, hot dipping, galvanizing, or thermal spraying. The material may be disposed within recesses formed in the bore of the holder. A material may be flush with the bore of the holder or it may extend into the bore.

Figure 23:
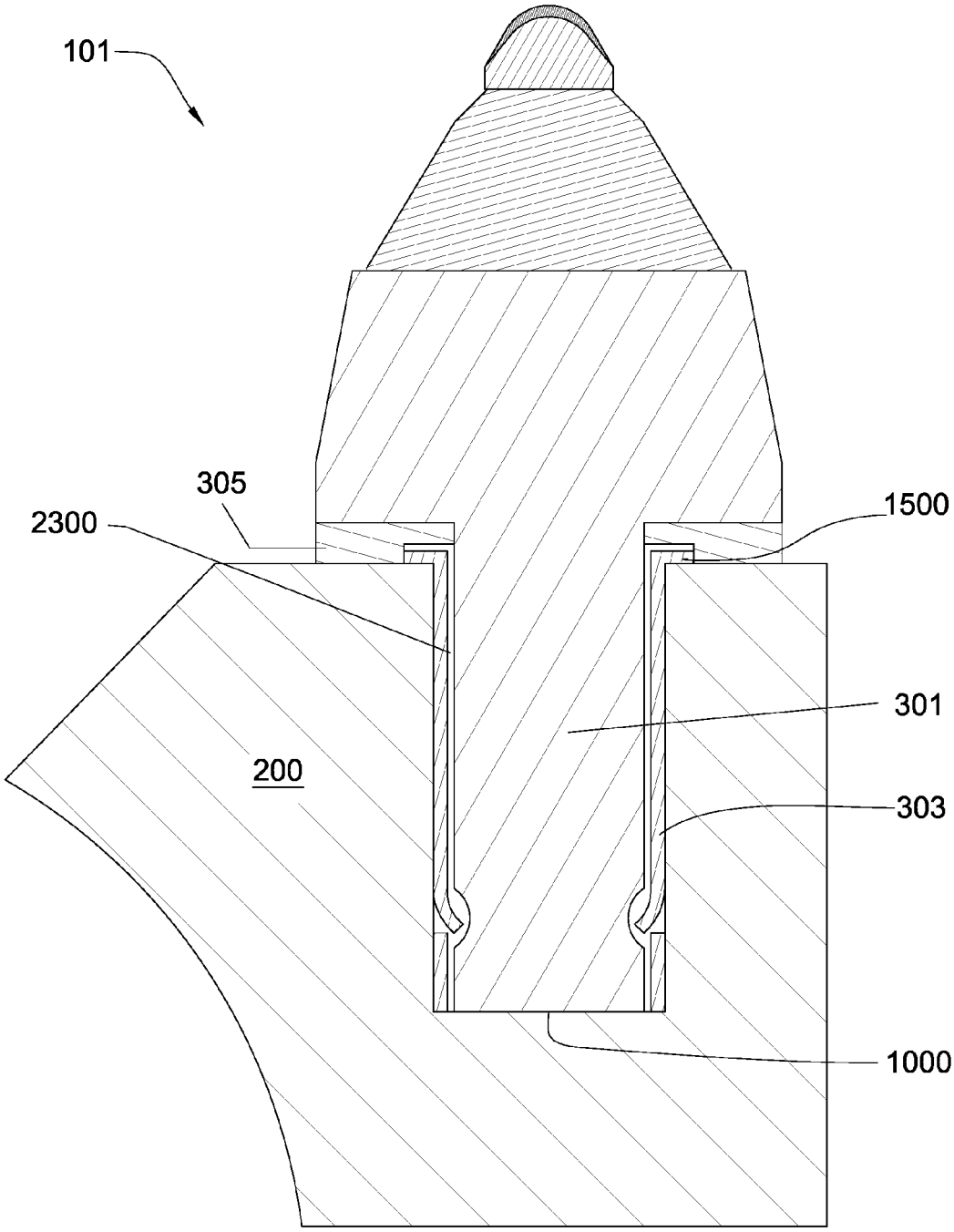
FIG. 23 is a cross-sectional diagram of another embodiment of a degradation assembly.

An annular gap 2300 may exist between a portion of the retainer sleeve 303 and the shank 301, as in the embodiment of FIG. 23. The size of the gap 2300 between the sleeve 303 and the shank 301 when inserted in the holder is important to the function and working life of the degradation assembly 101. Preferably the gap is 0.002 to 0.015. More preferably, the gap is 0.005 to 010 inches. The gap 2300 may also extend between the lip 1500 of the sleeve 303 and the washer 305. A similar gap may also exist between the sleeve 303 and the bore 1000 of the holder 200.

Figure 24:
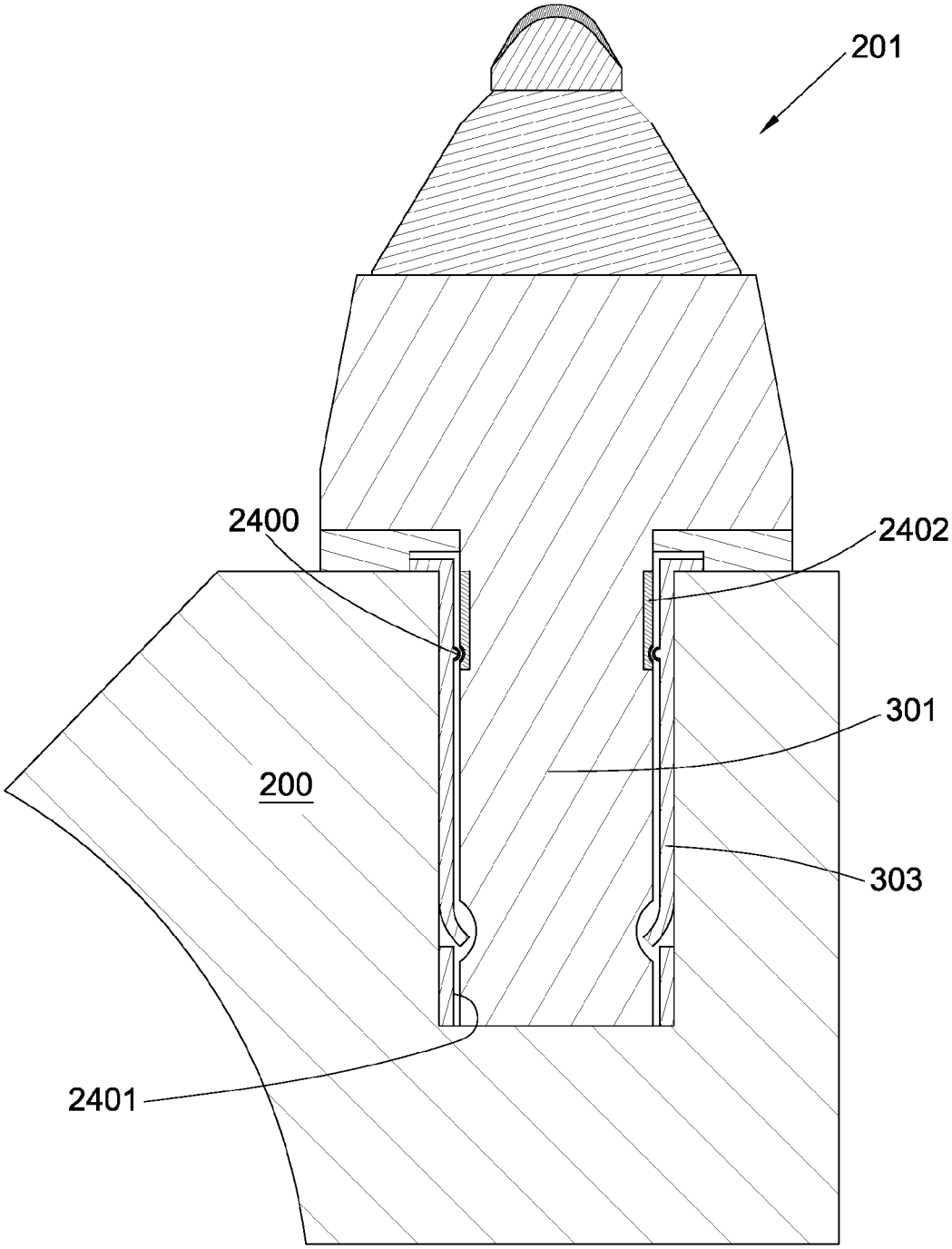
FIG. 24 is a cross-sectional diagram of another embodiment of a degradation assembly.

The retainer sleeve 303 may comprise at least one protrusion 2400 extending from an inner surface 2401 of the sleeve 303. In the embodiment of FIG. 24, the protrusion 2400 is an annular rib, though the protrusion 2400 may also be a bump or a ring of any kind. The protrusion 2400 may help the sleeve 303 stabilize the shaft 301 of the attack tool 201 when the attack tool engages a road or other formation while still allowing the attack tool 201 to rotate. The shaft 301 also may comprise a hard material 2402 such that it comes into contact with the protrusion 2400, thereby reducing the amount of wear to the shaft 301. In some embodiments, the shaft will only come into contact with the sleeve at the protrusion, so only the surface of the shaft adjacent the protrusion may comprise a wear resistant material. A gap between the protrusion and the shaft of 0.002 to 0.010 inches may exist.

Figure 25:
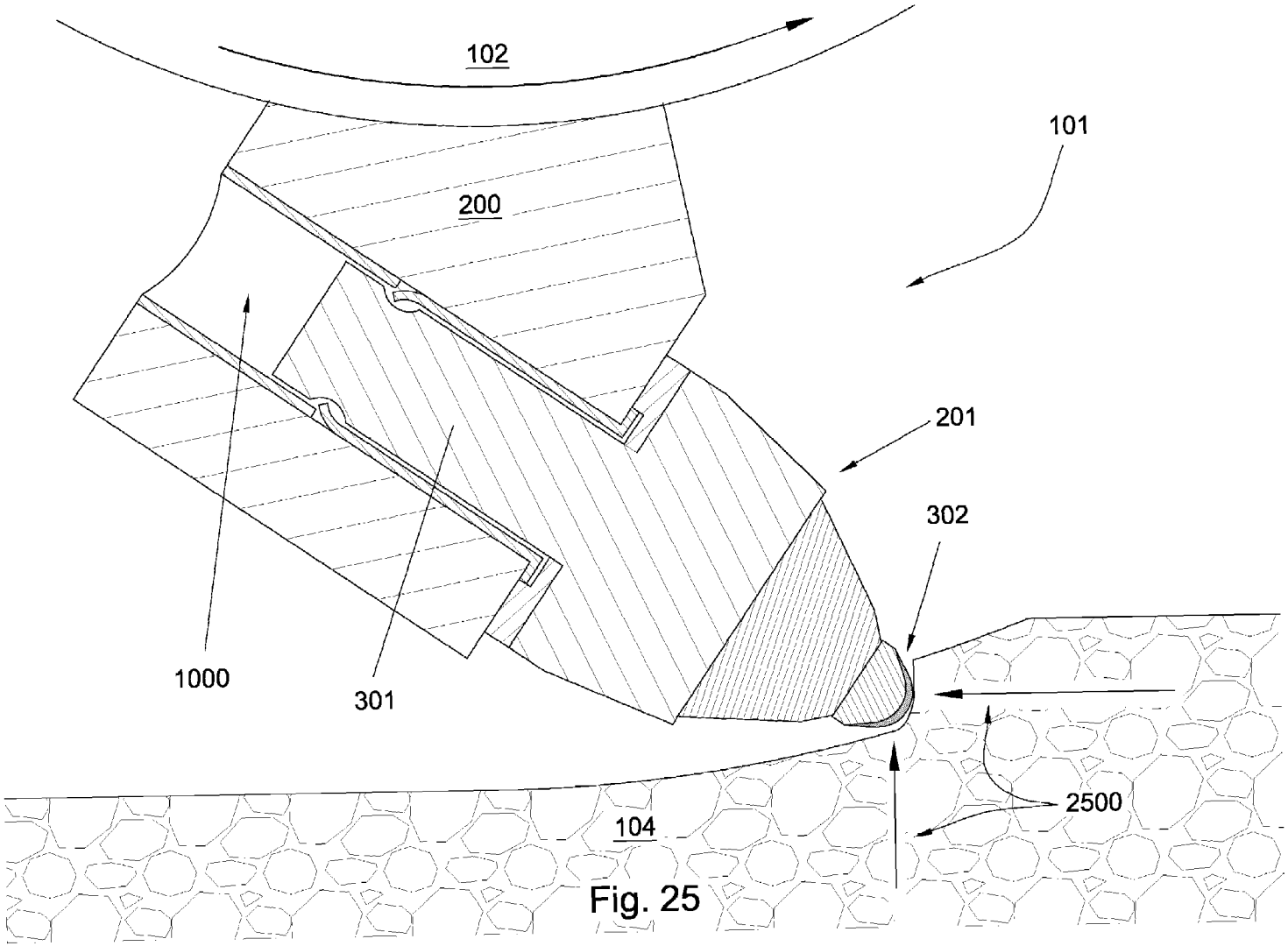
FIG. 25 is a cross-sectional diagram of another embodiment of a degradation assembly.

In the embodiment of FIG. 25, as the degradation assembly 101 degrades a paved surface 104, the tool experiences forces in both axial and lateral directions. These forces 2500 may cause the attack tool 201 to rotate and move within the bore 1000 of the holder 200. The rotation and movement cause various friction and vibratory effects on both the bore 1000 of the holder 200 and the shaft 301 of the attack tool 201, which may damage the holder 200 or attack tool 201 and limit the life of the degradation assembly 101. A gap size within the range of 0.002 to 0.015 inches is believed to allow the holder 200 to maintain a firm grip on the attack tool 201 and allow the attack tool 201 to rotate within the bore 1000 of the holder 200 while limiting damaging effects on the shank 301 and the holder 200. It is believed that a tip 302 with a superhard coating such as diamond will have a greater life than a traditional tip without diamond and that it will outlive the shank if there is too large of a gap between sleeve and shank. If the gap is too small, the pick will not be able to rotate.

In some embodiments, the sleeve may be press fit into place from either side of the holder before the attack tool is inserted. Preferably, the sleeve protects the holder from wearing.

Figure 26:
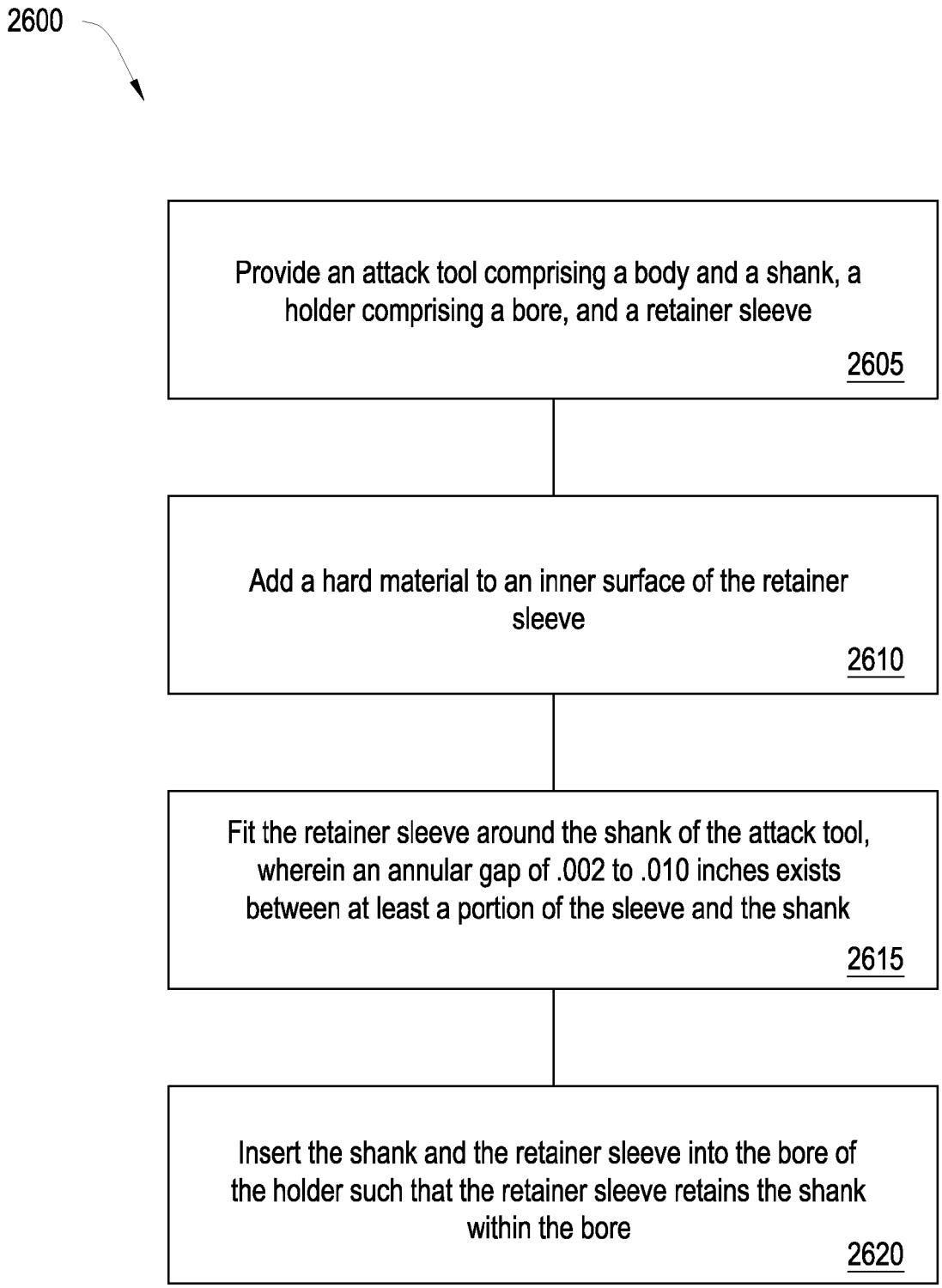
FIG. 26 is a diagram of a method for manufacturing a degradation assembly.

Referring to FIG. 26, a method 2600 for manufacturing a degradation assembly comprises providing 2605 an attack tool comprising a body and a shank, a holder comprising a bore, and a retainer sleeve; adding 2610 a hard material to an inner surface of the retainer sleeve; fitting 2615 the retainer sleeve around the shank of the attack tool, wherein an annular gap of 0.002 to 0.010 inches exists between at least a portion of the sleeve and around the shank; and inserting 2620 the shank and the retainer sleeve into the bore of the holder such that the retainer sleeve retains the shank within the bore.

Whereas the present invention has been described in particular relation to the drawings attached hereto, it should be understood that other and further modifications apart from those shown or suggested herein, may be made within the scope and spirit of the present invention.

What is claimed is:

1. A degradation assembly comprising:

an attack tool comprising a body and a shank, the body comprising a wear resistant tip comprising a hardness of at least 60 HRc;

the shank being disposed within a bore of a holder secured to a driving mechanism; and a retainer sleeve disposed around the shank of the attack tool, the retainer sleeve comprising an inner surface with a carbide thickness of 0.0001 and 0.5 inches; and a seal between the shank and the sleeve disposed proximate the rearward end of the shank;

wherein an annular gap of 0.002 to 0.007 inches exists between at least a portion of the sleeve and the shank.

2. The degradation assembly of claim 1, wherein the retainer sleeve comprises at least one protrusion extending from an inner surface of the sleeve.

3. The degradation assembly of claim 2, wherein the protrusion is a bump, a ring, a rib, or combinations thereof.

4. The degradation assembly of claim 1, wherein the inner surface of the sleeve is polished.

5. The degradation assembly of claim 1, wherein the inner surface comprises layers.

6. The degradation assembly of claim 1, wherein the inner surface is made of a polycrystalline ceramic with a binder concentration of 4 to 35 weight percent.

7. The degradation assembly of claim 1, wherein the retainer sleeve is a spring.

8. The degradation assembly of claim 1, wherein the retainer sleeve comprises a lip proximate an outer edge.

9. The degradation assembly of claim 1, wherein the retainer sleeve comprises a guide slot.

10. The degradation assembly of claim 9, wherein the shank comprises a guide pin, the guide slot of the retainer sleeve being adapted to receive the guide pin.

11. The degradation assembly of claim 1, wherein the retainer sleeve comprises a thickness from 0.01 to 0.5 inches.

12. The degradation assembly of claim 1, wherein a first end of the retainer sleeve comprises a larger diameter than a second end of the retainer sleeve.

13. The degradation assembly of claim 1, wherein the wear resistant tip comprises a material selected from the group consisting of chromium, tungsten, tantalum, niobium, titanium, molybdenum, carbide, natural diamond, polycrystalline diamond, vapor deposited diamond, cubic boron nitride, aluminum oxide, zircon, silicon, whisker reinforced ceramics, diamond impregnated carbide, diamond impregnated matrix, silicon bonded diamond, and combinations thereof.

14. The degradation assembly of claim 1, wherein the wear resistant tip comprises a binder concentration of 4 to 35 weight percent.

15. The degradation assembly of claim 1, wherein the wear resistant tip comprises an average grain size of 0.5 to 200 microns.

16. A method for manufacturing a degradation assembly comprising:

providing an attack tool comprising a body and a shank, a holder comprising a bore, and a retainer sleeve;

adding a carbide material of a thickness of 0.0001 to 0.5 inches to an inner surface of the retainer sleeve;

adding a seal between the shank and the sleeve proximate a rearward end of the shank;

fitting the retainer sleeve around the shank of the attack tool, wherein an annular gap of 0.002 to 0.007 inches exists between at least a portion of the sleeve and the shank; and inserting the shank and the retainer sleeve into the bore of the holder such that the retainer sleeve retains the shank within the bore.

* * * * *